United States Patent [19]

Scheffee

[11] Patent Number: 4,504,277

[45] Date of Patent: Mar. 12, 1985

[54] COAL-WATER FUEL SLURRIES AND PROCESS FOR MAKING SAME

[75] Inventor: Robert S. Scheffee, Lorton, Va.

[73] Assignee: Atlantic Research Corporation, Alexandria, Va.

[21] Appl. No.: 484,671

[22] Filed: Apr. 13, 1983

Related U.S. Application Data

[63] Continuation-in-part of Ser. No. 368,921, Apr. 16, 1982, , which is a continuation-in-part of Ser. No. 197,853, Oct. 17, 1980, abandoned, and Ser. No. 360,523, Mar. 22, 1982, Pat. No. 4,465,495.

[51] Int. Cl.[3] ..... C10L 1/32

[52] U.S. Cl. ..... 44/51; 406/47; 406/49

[58] Field of Search ..... 44/51; 406/47, 49

[56] References Cited

U.S. PATENT DOCUMENTS

| | | | |
|---|---|---|---|
| 3,168,350 | 2/1965 | Phinney et al. | 44/51 |
| 4,104,035 | 8/1978 | Cole et al. | 44/51 |
| 4,282,006 | 8/1981 | Funk | 44/51 |
| 4,304,572 | 12/1981 | Wiese et al. | 44/51 |
| 4,403,997 | 9/1983 | Poetschke | 44/51 |

FOREIGN PATENT DOCUMENTS

| | | | |
|---|---|---|---|
| 56-30963 | 4/1981 | Japan | 44/51 |

*Primary Examiner*—Y. Harris-Smith

*Attorney, Agent, or Firm*—Martha L. Ross

[57] ABSTRACT

Coal-water fuel slurries having long-term storage stability and improved viscosities and comprising finely-divided coal within efficient combustion size range, water, and minor amounts of ammonium salt organic dispersant and alkaline earth metal salt organic dispersant, and process for making such slurries.

21 Claims, No Drawings

COAL-WATER FUEL SLURRIES AND PROCESS FOR MAKING SAME

RELATED APPLICATIONS

This application is a continuation-in-part of patent application Ser. No. 368,921 filed April 16, 1982, which is a continuation-in-part of patent application Ser. No. 197,853, now abandoned and a continuation-in-part of No. 360,523 filed respectively Oct. 17, 1980, and Mar. 22, 1982 now U.S. Pat. No. 4,465,495.

BACKGROUND

A high fuel value coal-wter slurry which can be injected directly into a furnace as a combustible fuel can supplant large quantities of expensive fuel oil presently being used by utilities, factories, ships, and other commercial enterprises.

For many years, coal-water slurries have been successfully transported long distances by pipeline to point of use, such as a utility. Since practical, cost effective pipeline slurries do not possess the requisite characteristics for efficient use as fuels, present practice is to dewater, grind the dried coal cake to finer particle sizes, and spray the dried solid particles into the combustion chamber.

Pipline and fuel coal-water slurries differ markedly in required characterisitics because of their different modes of use.

For efficient, low-cost service, slurries which are pumped through pipelines for long distances should have the lowest possible viscosities and rheology which is preferably Newtonian with zero or negligible yield point. In practice, these requirements are achieved by coal concentrations which are considerably smaller than those desired in the fuel slurry. Particle sizes in the upper end of the size distribution range are excessively large for efficient combustion. A typical long-distance pipeline slurry containing no dispersant has a coal concentration of about 40 to 50% and a particle size distribution of 8 M×0 (U.S. Standard Sieve) with about 20% being −325 M.

A great deal of work has been done to make possible higher loadings in pipeline slurries by adding a suitable organic dispersant which reduces viscosity and improves particle dispersion. A dispersant which has been of particular interest is an anionic compound in which the anion is a high molecular weight organic moiety and the cation is monovalent, e.g., an alkali metal, such as Na or K. The anion attaches to the coal particles to give them a high negative charge or zeta potential, which causes repulsion sufficient to overcome Van der Waal's attraction and, thereby, prevents flocculation with concomitant reduction in viscosity. In accordance with DLVO theory, small monovalent cations maximize the desired negative zeta potential. This phenomenon is discussed in Funk U.S. Pat. No. 4,282,006, which also advises against the use of multivalent cations because they act as counterions which disadvantageously reduce zeta potential. The monovalent salt dispersants have been found to give essentially zero yield points. Pipeline slurries, including those containing the anionic alkali metal organic dispersants, when at rest, tend to separate gravitationally in a short period of time into supernantant and packed sediment which is virtually impossible to redisperse.

For efficient practical use as a fuel, the slurry must have several essential characteristics. It must have long-term static stability so that it can be stored for extended periods of time by suppliers or at the point of use. During such storage, they must remain uniformly dispersed or, at most, be subject to some soft subsidence which can be easily redispersed by stirring. By subsidence is meant a condition in which the particles do not segregate, as in sedimentation, but remain dispersed in the carrier fluid in a gel or gel-like formation. Uniform dispersion is essential for reliably constant heat output. Coal loadings must be sufficiently high, e.g., up to 65 to 70% or higher, to produce adequate fuel value despite the presence of the inert water carrier. The coal particles must be small enough for complete combustion in the combustion chamber. The slurry must also be sufficiently fluid to be pumped to and sprayed into a combustion chamber. However, the low viscosities required for pipelinable slurries are not required for a fuel slurry. Such fuel slurries have hitherto eluded the commercial art.

It is obvious that a process which can convert coal directly into a fuel slurry or transform pipeline slurry at its terminal into a fuel slurry having the aforedescribed characteristics without requiring dewatering the coal to dryness would be most advantageous.

Coal-water slurries which have the aforesaid requisite properties for effective use as fuels which can be used as a substitute for fuel oil, are disclosed in copending Robert S. Scheffee patent applications Ser. No 197,853 now abandoned and No. 360,523, the teachings of which are hereby incorporated by reference. These applications teach the use of alkaline earth metal organosulfonate dispersants to form stable coal-water fuel slurries which have coal-loading capacity as high as 70% or more and particular bimodal particle size distributions. The divalent metal salt acts both as dispersant and slurry stabilizer. The fuel slurries are thixotropic or Bingham fluids which have yield points; become fluid and pourable under relatively small stresses to overcome the yield point; and have the long-term static stability required for a practical fuel. The viscosities of these slurries, though not excessively large for handling and use, are considerably higher than those obtained with ammonium salts alone.

Fuel slurries, such as those prepared in accordance with the present invention, which have substantially lower viscosities than those obtained with the divalent salts alone, while retaining the same long-term static stability and other properties required for use as a fuel, have important advantages in terms of ease of handling and power consumption. Application Ser. No. 368,921 discloses that the use of anionic monovalent cation salt organic dispersant, such as the alkali metal salts together with anionic alkaline earth metal salt organic dispersant, produces these highly desirable results. It has been found that use of the ammonium salt as the cationic monovalent salt provides the desired results and has the additional advantage of not producing slag as a combustion product.

Generally, the prior art has focused on reducing viscosity and, thereby, increasing loadings and pumpability of pipeline slurries. The art has taught the use of anionic ammonium, alkali metal, or alkaline earth metal organic dispersants as equivalents for these objectives, and has shown the monovalent cationic salt dispersants to be superior. None of the references teach or suggest the unique capability of the alkaline earth metal salts as long-term static stabilizers or their combination with monovalent cation salts such as alkali metal or $NH_4$ salt derivatives, to produce the stable fuel slurries of the present invention. References of interest include Wiese et al. U.S. Pat. No. 4,304,572 and Cole et al. U.S. Pat. No. 4,104,035 which disclose the use of ammonium, alkali metal or alkaline earth metal salts of organosulfonic acids to improve slurry loading and pumpability. In both cases the data show the monovalent salts to be superior for the stated objectives.

SUMMARY

Fuel slurries comprising up to about 70% or higher of coal stably dispersed in water are produced by admixing finely-divided coal, water, a minor amount of anionic ammonium salt organic dispersant, and a minor amount of anionic alkaline earth metal salt organic dispersant.

The coal particle sizes should be within efficient combustion size range. Given the present state of the art, 100% of the coal is desirably about −40 M (420μ) and at least about 40% is −200 M. Preferably, at least about 50% is −200 M. A suitable coal size distribution is prepared from a bimodal mixture comprising about 10 to 50 wt. %, preferably 10 to 30 wt. % on slurry, of particles having a size up to about 30μ MMD (mass median diameter), preferably about 1 to 15μ MMD, as measured by a forward scattering optical counter, with the rest of the coal being larger particles having a size range of about 20 to 200μ MMD. Crushed coal can be ground in known manner to produce the particle sizes required for preparation of the fuel slurries.

The actual degree of coal loading is not critical so long as it is sufficient to provide adequate heat output. The maximum concentration of coal successfully incorporated into a given slurry may vary with such factors as particle size distribution, the particular dispersants used and their total and relative concentrations.

As disclosed in Ser. No. 197,853, the alkaline earth metal salt organic dispersant is added to the slurry in an amount sufficient to impart a substantial yield point and to maintain the slurry in stable dispersion for extended storage periods without separation of the coal particles into packed sediment.

The $NH_4$ salt organic dispersant is added to the slurry in an amount sufficient to impart substantially reduced viscosity, as compared with that imparted by the alkaline earth metal salt organic dispersant alone without destabilizing the slurry. As will be seen from the Examples, the slurries containing only the ammonium salt generally have a minimal yield point. Also as disclosed in Ser. No. 197,853, the long-term static stability requires a thixotropic or Bingham fluid with an appreciable yield point. The optimum amount of the combination of alkaline earth metal and ammonium salt organic dispersants which will accomplish the desired long-term stability results without excessive increase in yield point or viscosity can readily be determined by routine tests to determine yield point and viscosity in which the amounts and ratios of the ammonium and alkaline earth metal salt dispersants are varied.

It is believed that the relative proportions of the available ammonium and alkaline earth metal cations provided by the respective dispersants play an important role in imparting stability and determining yield point and viscosity. However, so many other factors, such as the particular coal, the particular particle size distribution, and the particular dispersant anions, also affect rheological properties in varying and generally unquantifiable degree, that it is difficult to specify generically an optimum ratio of the mono- and divalent cations which would necessarily apply to different specific slurries. In general, increasing valency of the cationic charge by increasing the ratio of the divalent to monovalent cations, e.g., $Ca^{++}:NH_4^+$, produces increasingly stable soft gels, with increase in yield point and viscosity as the proportion of multivalent ions increases.

The anionic ammonium and anionic alkaline earth metal (e.g., Ca, Mg) organic dispersants preferably have organic moieties which are multifunctional and high molecular weights, e.g., about 1,000 to 25,000. Examples of useful dispersants include organosulfonates, such as the $NH_4$ lignosulfonates, $NH_4$ napthhalene sulfonates, Ca lignosulfonates, and Ca naphthalene sulfonates, and organo carboxylates, such as $NH_4$ lignocarboxylate. The ammonium and alkaline earth metal organosulfonates are preferred. The total amount of the two types of dispersant used is minor, e.g., about 0.1 to 5 pph coal, preferably about 0.5 to 2 pphc.

In some cases, it may be desirable to add an inorganic salt or base to control pH of the slurry in the range of about pH4 to 11. This may improve aging stability, pourability, and handling characteristics of the slurry. A salt, such as ammonium phosphate, or a base, such as $NH_4OH$, NaOH or KOH, is used in minor amounts sufficient to provide the desired pH, e.g., about 0.1 to 2% based on the water. Other additives which may be included are biocides and anti-corrosion agents.

The finely-divided coal particles, water, and dispersants are mixed in a blender or other mixing device which can deliver high shear rates. High shear mixing, e.g., at shear rates of at least about 100 $sec^{-1}$, preferably at least about 500 $sec^{-1}$, as disclosed in patent application Ser. No. 197,853 is essential for producing a stable slurry free from substantial sedimentation.

The slurries can generally be characterized as thixotropic or Bingham fluids having a yield point. When at rest, the slurries may gel or flocculate into nonpourable compositions which are easily rendered fluid by stirring or other application of relatively low shear stress sufficient to overcome the yield point. They can be stored for long periods of time without separation into packed sediment. They may exhibit some soft subsidence which is easily dispersed by stirring. Slurries embodying these characteristics are included in the term "stable, static dispersions" as employed in the specification and claims. The slurries can be employed as fuels by injection directly into a furnace previously brought up to ignition temperature of the slurry.

In addition to preparing the stable fuel slurry directly from dry coal ground to the desired particle sizes as aforedescribed, the invention can be employed to convert a pipeline slurry at its destination into a fuel slurry and, thereby, eliminate the present costly requirement for complete dewatering. The process of the invention is highly versatile and can be applied to a wide variety of pipeline slurries.

The details of the conversion process are determined by the make-up of the particular pipeline slurry. As aforedescribed, pipeline slurries generally have lower coal concentrations and larger particle sizes than are required for effective fuel use and may or may not include a viscosity-reducing, monovalent cation salt organic dispersant.

In the case of pipeline slurries which do not contain dispersant, the following procedures can be used:

Coal concentration can be increased to fuel use requirements by partial dewatering or by addition of coal. After such adjustment, the slurry is passed through a comminuting device, such as a ball mill, to reduce the coal particles to the desired fuel size. It should be noted that increasing concentration by coal addition can be done after ball milling, but preferably precedes it.

Addition of the ammonium and alkaline earth metal organic dispersants can be done after the milling. Preferably at least some to all of the ammonium or alkaline earth metal dispersant or some to all of both are added to the coal-water slurry prior to milling. When only a portion of the dispersant(s) is added during milling, the remainder is added subsequently, together with any other additives such as biocides, buffer salts, bases and the like. The slurry mixture is then subjected to high shear mixing, as aforedescribed. The amount and ratio of total ammonium and alkaline earth metal dispersants added for optimum stability, viscosity, and yield point are determined by routine tests as aforedescribed.

In the case of pipeline slurries which include an ammonium salt organic dispersant to reduce viscosity and increase coal concentration, the following procedures can be used:

If the coal concentration is inadequate for fuel use, it can be adjusted by partial dewatering or addition of coal. If coal concentration in the pipeline slurry is adequate, this step can be omitted. Generally, coal particle sizes are larger than desired for fuel use for reasons of reducing viscosity, so that the slurry requires passage through a milling device. The slurry contains its original ammonium salt organic dispersant which assists in the milling procedure. Some or all of the alkaline earth metal dispersant can also be added to the wet milling process.

After determination of the concentration of ammonium salt dispersant in the pipeline slurry, the optimum amount of alkaline earth metal dispersant and any additional ammonium dispersant required is determined by routine test. After addition of dispersant and any other desired additives, such as biocides, buffer compounds, bases, and anti-corrosion agents, the slurry mixture is subjected to high shear mixing.

The fuel slurries made from the long-distance pipeline slurries are substantially the same as those produced directly from dry coal.

DETAILED DESCRIPTION

Example 1

A series of slurries containing 65% by weight of West Virginia bituminous coal was prepared with 1.0 pphc (parts per hundred of coal), (0.65% slurry) of a mixture of $NH_4$ and Ca lignosulfonates and with 1.0 pphc of the $NH_4$ or Ca dispersant only. The coal was a bimodal blend comprising 70% of a coarse fraction having an MMD of 37$\mu$ and a maximum size of about 300$\mu$ and 30% of a fine fraction having a 7.8$\mu$ MMD (45.5 and 19.5% respectively by weight of slurry). MMD of the blend was 16$\mu$.

The larger particle sizes were determined by sieving. Sub-sieve particle sizes were determined by a forward scattering optical counter which is based on Fraunhofer plane diffraction.

The coarse fraction was prepared by dry ball milling and sieving through a 50 mesh screen. The fine grind was prepared by wet ball milling for 2 hours. The wet ball milling was done with 60% of total dispersant. The remaining 40% was added during mixing. Preferably, though not essentially, the coal is milled with water so that the very fine particles are in water slurry when introduced into the mixer. At least some of the dispersant is included in the ball milling operation to improve flow and dispersion characteristics of the fine particle slurry.

The fuel slurry blends were prepared by mixing the coarse fraction, the fine ball-milled fraction, additional dispersant, and water in the amounts required for the desired slurry composition. Each of the slurries also contained 0.2 pphc $NH_4OH$, to provide a slightly basic pH. The amounts of the $NH_4$ and Ca dispersants were changed to vary the ratio of the $NH_4+$ and $Ca++$ cations. The weight ratio of $NH_4$ to Ca dispersant was varied from 1:0 to 0:1 pphc. While the total dispersant content was maintained constant at 1 pphc, the total product of valence times cation molar content was held constant at 2.4 charges per unit weight of coal. Thus the valency was systematically varied from monovalent to divalent while maintaining constant total charge. The particular dispersants used were an ammonium lignosulfonate containing 4.4 wt % $NH_4$ and a calcium lignosulfonate containing 5% Ca.

The slurries were prepared by premixing the dry-milled and wet-milled grinds and the remaining dispersant, base, and water in a planetary baker's type low-shear mixer, followed by high-shear mixing (Oster) at a shear rate of about 1000 $sec^{-1}$. The "low-sheared" and "high sheared" samples were evaluated for pH, yield point, and viscosity, and were stored at room temperature (70° F.) for observations of stability. Yield point and viscosity were measured using a Brookfield rotational viscometer with cylindrical spindles.

Results are summarized in Table 1.

It will be seen that none of the low-sheared mixes was stable, demonstrating that high shear mixing is an essential processing step for stability.

The ammonium dispersant alone imparts very low viscosity and negligible yield point, which makes it suitable for pipeline use, and no appreciable static stability, which makes it unfit for use as a fuel. The Ca dispersant alone imparts substantially higher viscosity and yield point, which makes it unfit for practical use as a pipelinable slurry, and long-term static stability, which makes it suitable for use as a fuel.

The data also show that as valency of the cation charge is increased by reducing $NH_4$ concentration and increasing Ca content, viscosity, yield point, and stability increase until, at an $NH_4$/Ca dispersant ratio of 0.2/0.8, the slurry is substantially as stable as the Ca only slurry and has substantially lower viscosity and yield point, namely 3.7 p and 1.0 dyne/$cm^2$ vs. 5.9 p and 7.5 dynes/$cm^2$. The $NH_4$/Ca slurry, like the Ca-only slurry, is still stable after static storage for up to 2 weeks.

It can be seen that the monovalent $NH_4$ dispersant can be added to the highly stable Ca dispersant slurries to reduce viscosity and yield point without sacrificing the long-term static stability essential for a storage fuel slurry.

Example 2

A series of slurries containing 65% by weight (bone dry) of West Virginia bituminous coal was prepared by charging a ball mill with crushed coal, additives, and water, and milling to a size consist of 100% −100 M and 90–95% −200 M. The coal feed had been crushed to a size consist of 10 M×0 (<2000μ), and as in Example 1, the additives were $NH_4$ and Ca lignosulfonates at a constant dispersant content of 1 pphc, and 0.2 pphc $NH_4OH$. Upon being discharged from the mill, the slurries were mixed in a high shear mixer at a shear rate of about 1000 $sec^{-1}$. Samples of sheared and unsheared slurry were stored at room temperature for observation of stability, after having been evaluated for pH and viscosity. These evaluations were carried out as described previously in Example 1. The results of these tests are summarized in Table 2.

As in Example 1, the $NH_4$ dispersant alone imparts low viscosity, negligible yield point, and inadequate static stability. Ca dispersant alone imparts relatively high viscosity and yield point and good long-term static stability. As the ratio of $NH_4$/Ca in the mixed dispersants drops, viscosity, yield point, and stability increase. At $NH_4$/Ca ratios of 0.4/0.6 and 0.2/0.8, despite substantially lower viscosity and yield point as compared with the 0.1 ratio, long term static stability is substantially the same, namely at least two weeks.

Example 3

A 65 wt. % pipeline bituminous coal-water slurry was prepared by mixing 45.5 parts of a coarse fraction crushed to 10 M (2000μ)×0 with an MMD of 530μ; 19.5 parts of a fine coal fraction wet ball milled to 50 M (300μ)×0 and an MMD of 18μ; 0.65 parts of an ammonium lignosulfonate containing 2.4 mmol $NH_4$ per 100 g coal, and a total of 33.35 parts water.

The coal, water, and $NH_4$ dispersant were mixed in a Hobart mixer. Viscosity of the mix was 1.25 p. Although the slurry was exceedingly unstable at rest, the very low viscosity obtained with the $NH_4$ lignosulfonate dispersant makes it useful as a long-distance pipeline slurry.

0.65 parts of a calcium lignosulfonate were added to the above slurry, which was then charged to an 8 $\frac{5}{8}$ inch diameter ball mill and milled 45 minutes. The resulting slurry was fluid and had a size consist of 99.6% −140 M with 96% −200 M, which is well within the desired particle size range for efficient combustion. It was then subjected to high shear mixing at about 6000 rpm in an Oster blender. After the blending, viscosity at 10 $sec^{-1}$ was 4.8 p. The slurry was fluid and stable. At rest, it was a soft non-pourable gel with slight supernatant and very slight sediment after seven days. It became fluid and pourable with easy stirring.

TABLE 1

| Lignosulfonate content, pphc | | $NH_4$/Ca Molar Ratio, mmoles per 100 gm coal | High Shear Mixed | Rheological Constants: Viscosity Poise at 10 $sec^{-1}$ | Rheological Constants: Yield Point dynes/$cm^2$ | pH | Stability @ 1 Day | | | Stability @ ~ 1-2 week | | |
|---|---|---|---|---|---|---|---|---|---|---|---|---|
| $NH_4$ | Ca | | | | | | Super. | Sub. | Sed. | Super. | Sub. | Sed. |
| 1.0 | 0 | 2.4/0 | No | 3.8 | .7 | 8.6 | Yes | Pkd | — | | | |
| | | | Yes | 1.3 | .3 | 8.2 | Yes | Pble | Pkd | Yes | Pkd | |
| 0.6 | 0.4 | 1.4/.48 | No | 7.3 | 0.5 | 9.0 | Yes | Pkd | | | | |
| | | | Yes | 2.0 | 0.7 | 9.0 | Yes | Pble | Sl | Yes | Pkd | |
| 0.5 | 0.5 | 1.2/.6 | No | 7.1 | 0.5 | 9.0 | Yes | Pkd | | | | |
| | | | Yes | 2.4 | 0.3 | 9.0 | Sl | Pble | Sl | Yes | Pkd | |
| 0.4 | 0.6 | .96/.72 | No | 7.3 | 0.7 | 9.1 | Yes | Pkd | | | | |
| | | | Yes | 3.0 | 0.7 | 9.0 | Sl | Pble | Sl | Yes | Pkd | |
| 0.2 | 0.8 | .48/.96 | No | 4.7 | 0.9 | 9.1 | Yes | Pkd | | | | |
| | | | Yes | 3.7 | 1.0 | 9.0 | No | Pble | No | Sl | V.Soft | No |
| 0 | 1.0 | 0/1.2 | No | 6.4 | 0.9 | 8.8 | Yes | Pkd | | | | |
| | | | Yes | 5.9 | 7.5 | 9.0 | No | Pble | No | Sl | Soft | No |

Abbreviations:
Super. = superate
Sl. = slight
Sub. = subsidence
Pble = pourable
Sed. = sediment
Pkd = packed

TABLE 2

| Lignosulfonate content, pphc | | $NH_4$/Ca Molar Ratio, mmoles per 100 gm coal | High Shear Mixed | Rheological Constants: Viscosity Poise at 10 $sec^{-1}$ | Rheological Constants: Yield Point dynes/$cm^2$ | pH | Stab. @ 1 day | | | @ ~ 1 week | | | @ ~ 2 weeks | | |
|---|---|---|---|---|---|---|---|---|---|---|---|---|---|---|---|
| $NH_4$ | Ca | | | | | | Super. | Sub. | Sed. | Super. | Sub. | Sed. | Super. | Sub. | Sed. |
| 1 | 0 | 2.4/0 | Yes | 1.4 | 0.08 | | Yes | Pble | Soft | Yes | Pble | Pkd | Yes | Pble | Pkd |
| 0.6 | 0.4 | 1.4/.48 | No | 2.7 | 0.05 | 9.3 | Yes | Pble | Pkd | | | — | | | |
| | | | Yes | 3.1 | 0.05 | | Yes | Pble | No | Yes | Pble | Pkd | Yes | Pble | Pkd |
| 0.4 | 0.6 | .96/.72 | No | 4.1 | 0.23 | 9.4 | Yes Pble | Pble | Pkd | Yes | Non- | Pkd | | | |
| | | | Yes | 3.8 | 0.1 | | No | Pble | No | Sl | Pble | No | Sl | Soft | No |
| 0.2 | 0.8 | .48/.96 | No | 4.2 | 0.13 | 9.4 | Yes | Pble | Pkd | Yes | Pble | Pkd | Yes | Pkd | |
| | | | Yes | 4.2 | 0.10 | | No | Soft | No | Sl | Soft | No | Yes | Soft | Sl |
| 0 | 1.0 | 0/1.2 | Yes | 8.3 | 13 | 9.4 | No | Soft | No | Sl | Soft | No | Yes | Soft | No |

to the desired reduced size consist; and high shear mixing. In this case the 65% pipeline coal concentration was adequate for efficient use as a fuel. It should be understood that if coal concentration in the pipelinable slurry is inadequate, it can be increased by partial dewatering or addition of dry coal. If the pipeline slurry does not contain dispersant, the ammonium salt organic dispersant can be added prior to milling, or before or after high shear mixing, preferably before.

This example also demonstrates the importance of high shear mixing in preparation of the stable fuel slurry.

While the present invention has been described by specific embodiments thereof, it should not be limited thereto, since obvious modification will occur to those skilled in the art without departing from the spirit of the invention or the scope of the claims.

I claim:

1. A coal-water fuel slurry which comprises:

a. finely-divided coal having a particle size distribution within efficient combustion size range, said coal being in amount sufficient to provide a desired coal concentration in the slurry;

b. a minor amount of anionic ammonium salt organic dispersant sufficient to reduce substantially viscosity of the slurry;

c. a minor amount of anionic alkaline earth metal salt organic dispersant sufficient to produce a slurry yield point larger than that obtained with said ammonium salt alone and to maintain the slurry in stable static dispersion; and d. water in amount sufficient to provide the liquid carrier for the slurry.

2. The slurry of claim 1 in which the size distribution is such that about 100% passes through 40 mesh with at least about 40% passing through 200 mesh.

3. The slurry of claim 2 in which the alkaline earth metal salt dispersant is an organosulfonate.

4. The slurry of claim 3 in which the ammonium salt dispersant is an organosulfonate.

5. The slurry of claim 1 in which the coal particle sizes comprise:

a. fine particles having a maximum size of about 30μ MMD in amount comprising about 10 to 50% by weight of the slurry, and b. larger coal particles within the range of about 20 to 200μ MMD, wherein sub-sieve particle sizes are defined in terms of those obtained by forward scattering optical counter.

6. The slurry of claim 5 in which the alkaline earth metal dispersant is an organosulfonate.

7. The slurry of claim 6 in which the ammonium dispersant is an organosulfonate.

8. The slurry of claim 6 in which the alkaline earth metal dispersant is a Ca lignosulfonate.

9. The slurry of claim 7 in which the ammonium dispersant is a lignosulfonate.

10. Process for making stable coal-water fuel slurry, which comprises:

a. admixing:

(i) finely-divided coal having a particle size distribution within efficient combustion size range, said coal being in amount sufficient to provide a desired coal concentration in the slurry;

(ii) a minor amount of anionic ammonium salt organic dispersant sufficient to reduce substantially viscosity of the slurry;

(iii) a minor amount of anionic alkaline earth metal salt organic dispersant sufficient to produce a slurry yield point larger than that obtained with said ammonium dispersant alone and to maintain the slurry in stable static dispersion; and (iv) water in amount sufficient to provide the liquid carrier for the slurry, and b. subjecting the mixture to high shear mixing at a shear rate of at least about 100 $sec^{-1}$.

11. The process of claim 10 in which the size distribution is such that about 100% passes through 40 mesh with at least about 40% passing through 200 mesh.

12. The process of claim 11 in which the alkaline earth metal dispersant is an organosulfonate.

13. The process of claim 12 in which the ammonium dispersant is an organosulfonate.

14. The process of claim 10 in which the coal particle sizes comprise:

a. fine particles having a maximum size of about 30μ MMD in amount comprising about 10 to 50% by weight of the slurry; and b. larger coal particles within the range of about 20 to 200μ MMD wherein sub-sieve particle sizes are in terms of those obtained by forward scattering optical counter.

15. The process of claim 14 in which the alkaline earth metal dispersant is an organosulfonate.

16. The process of claim 15 in which the ammonium dispersant is an organosulfonate.

17. Process for converting a coal-water pipeline slurry into a stable fuel slurry, wherein the pipeline slurry contains particles of excessive size for efficient combustion, which comprises:

a. partially dewatering or adding finely-divided coal in an amount sufficient to increase the coal content in the pipeline slurry to a concentration desired in the fuel slurry, if the coal concentration in the aqueous pipeline slurry is less than that desired in the fuel slurry;

b. passing said slurry through a comminuting means to reduce excessively sized coal particles to sizes within an efficient combustion range;

c. adding to the slurry a minor amount of:

(i) anionic ammonium salt organic dispersant sufficient to reduce substantially viscosity of the slurry, and (ii) alkaline earth metal salt organic dispersant sufficient to produce a slurry yield point larger than that produced with said ammonium dispersant alone and to maintain the slurry in stable static dispersion; and d. subjecting the mixture comprising said coal, said ammonium and alkaline earth metal dispersants and water to high shear mixing at a shear rate of at least about 100 $sec^{-1}$.

18. The process of claim 17 in which at least some of the ammonium dispersant is a component of the pipeline slurry.

19. The process of claim 17 in which the comminuting means produces a particle size distribution such that about 100% passes through 40 mesh with at least about 40% passing through 200 mesh.

20. The process of claim 19 in which the alkaline earth metal salt is an organosulfonate.

21. The process of claim 20 in which the ammonium salt is an organosulfonate.

* * * * *